United States Patent [19]

Dyck

[11] Patent Number: 4,557,633

[45] Date of Patent: Dec. 10, 1985

[54] PORTABLE FORM FOR LINING IRRIGATION DITCHES

[76] Inventor: John W. Dyck, Box 158, Lethbridge, Alberta, Canada, T1J-3Y5

[21] Appl. No.: 519,534

[22] Filed: Aug. 1, 1983

[51] Int. Cl.[4] ..... E02B 5/02

[52] U.S. Cl. ..... 405/268; 404/100

[58] Field of Search ..... 405/268, 303; 404/100, 404/101, 105

[56] References Cited

U.S. PATENT DOCUMENTS

| | | | |
|---|---|---|---|
| 2,551,110 | 5/1951 | Fuller | 61/63 |
| 2,625,754 | 1/1953 | Morgan | 37/98 |
| 2,628,056 | 2/1953 | Fuller | 251/19 |
| 2,782,535 | 2/1957 | Fuller et al. | 37/97 |
| 2,975,602 | 3/1961 | Stromberg | 405/268 |
| 2,996,963 | 8/1961 | Stultz et al. | 404/100 |
| 3,477,354 | 11/1969 | Rink | 404/100 |
| 4,360,293 | 11/1982 | Wade | 405/268 |
| 4,472,089 | 9/1984 | Bruderle et al. | 405/268 |

*Primary Examiner*—David H. Corbin

*Attorney, Agent, or Firm*—Warren F. B. Lindsley

[57] ABSTRACT

A movable form for lining irrigation ditches with concrete and simultaneously installing wire mesh into approximately the center of the wet concrete being poured.

10 Claims, 8 Drawing Figures

FIG. 2
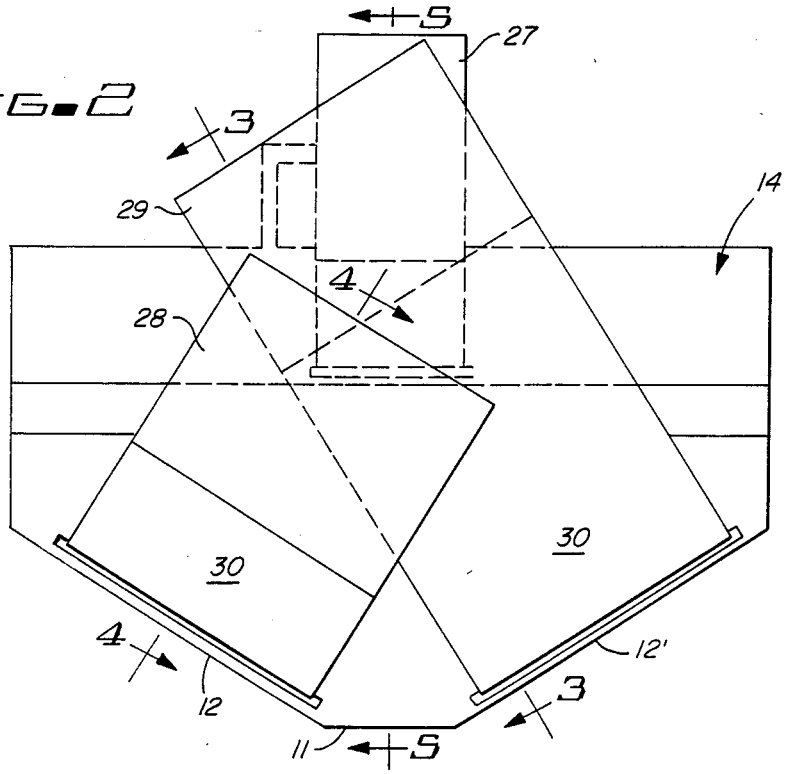
FIG. 3
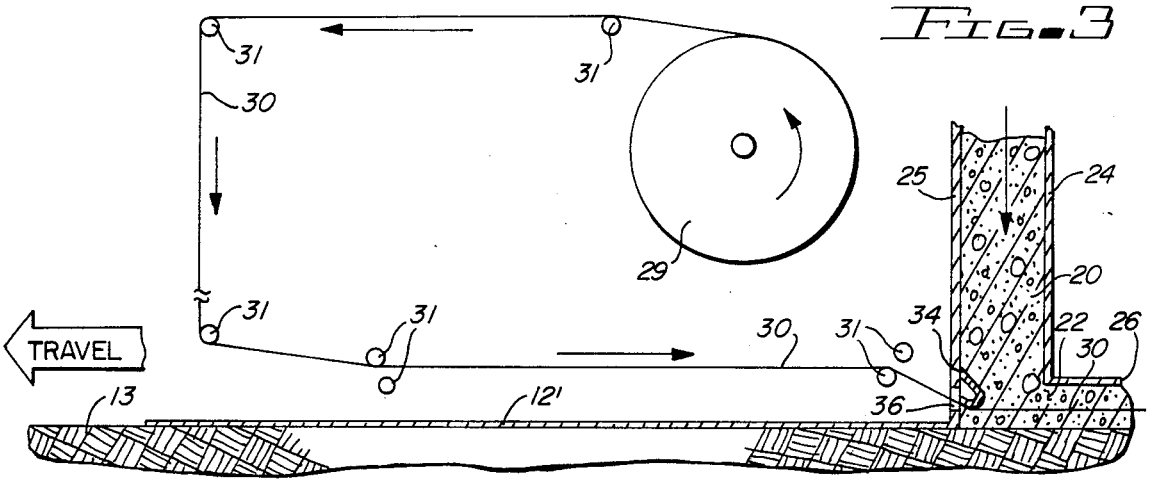
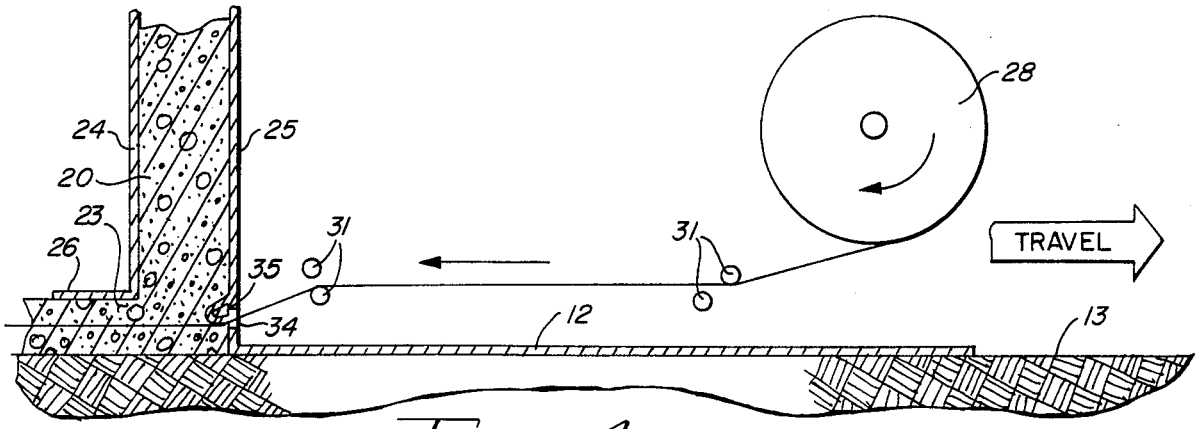
FIG. 4

PORTABLE FORM FOR LINING IRRIGATION DITCHES

BACKGROUND OF THE INVENTION

This invention pertains to movable forms for lining irrigation ditches with concrete, and more particularly to the installation of wire mesh into the center of wet concrete simultaneously being poured, thereby eliminating the prior art procedure of installing the wire mesh in a separate operation before the paving commences.

DESCRIPTION OF THE PRIOR ART

Heretofore, concrete reinforcements, such as iron rods, wire mesh and the like have been separately installed in irrigation ditches or channels prior to lining them with concrete.

U.S. Pat. No. 2,551,110 is directed to a portable form for lining irrigation ditches. The disclosed device slides along a prepared earthen ditch and deposits a layer of concrete on the bottom and sides of the ditch as it is drawn therealong. Certain forward parts of the form are arranged to ride on the bottom and sides of the ditch and gain support therefrom, while rear outer portions act as trowling elements to position, settle and smooth the concrete poured.

U.S. Pat. Nos. 2,625,754; 2,628,056 and 2,782,535 disclose other forms of ditch forming and accessory installing ditch lining equipment.

SUMMARY OF THE INVENTION

In accordance with the invention claimed, a new and improved process is disclosed for installing wire mesh into the center of a ribbon of wet concrete being poured that insures a complete uniform reinforcement of the concrete covering the area being paved and an apparatus for implementation thereof.

It is, therefore, one object of this invention to provide a new and improved method and device for installing wire mesh in the center of a web of wet concrete being poured.

Another object of this invention is to provide a new and improved device for installing wire mesh stored in a rolled configuration in a web of concrete being poured in a manner that insures complete uniform mesh coverage of the area being paved.

A further object of this invention is to provide a new and improved device for installing wire mesh in wet concrete being poured which overlaps to insure complete mesh coverage of the area being paved.

These and other objects and advantages of the invention will become apparent as the following description proceeds and the features of novelty which characterize this invention will be pointed out with particularity in the claims annexed to and forming a part of this specification.

BRIEF DESCRIPTION OF THE DRAWINGS

The present invention may be more readily described by reference to the accompanying drawings, in which:

FIG. 2 is a diagrammatic plan view of the rolls of wire mesh and their positions relative to the sides and bottom of the ditch being paved;

FIG. 3 is a cross-sectional view of FIG. 2 taken along the line 3—3;

FIG. 4 is a cross-sectional view of FIG. 2 taken along the line 4—4;

DESCRIPTION OF THE PREFERRED EMBODIMENT

Figures 1, 6, 7:
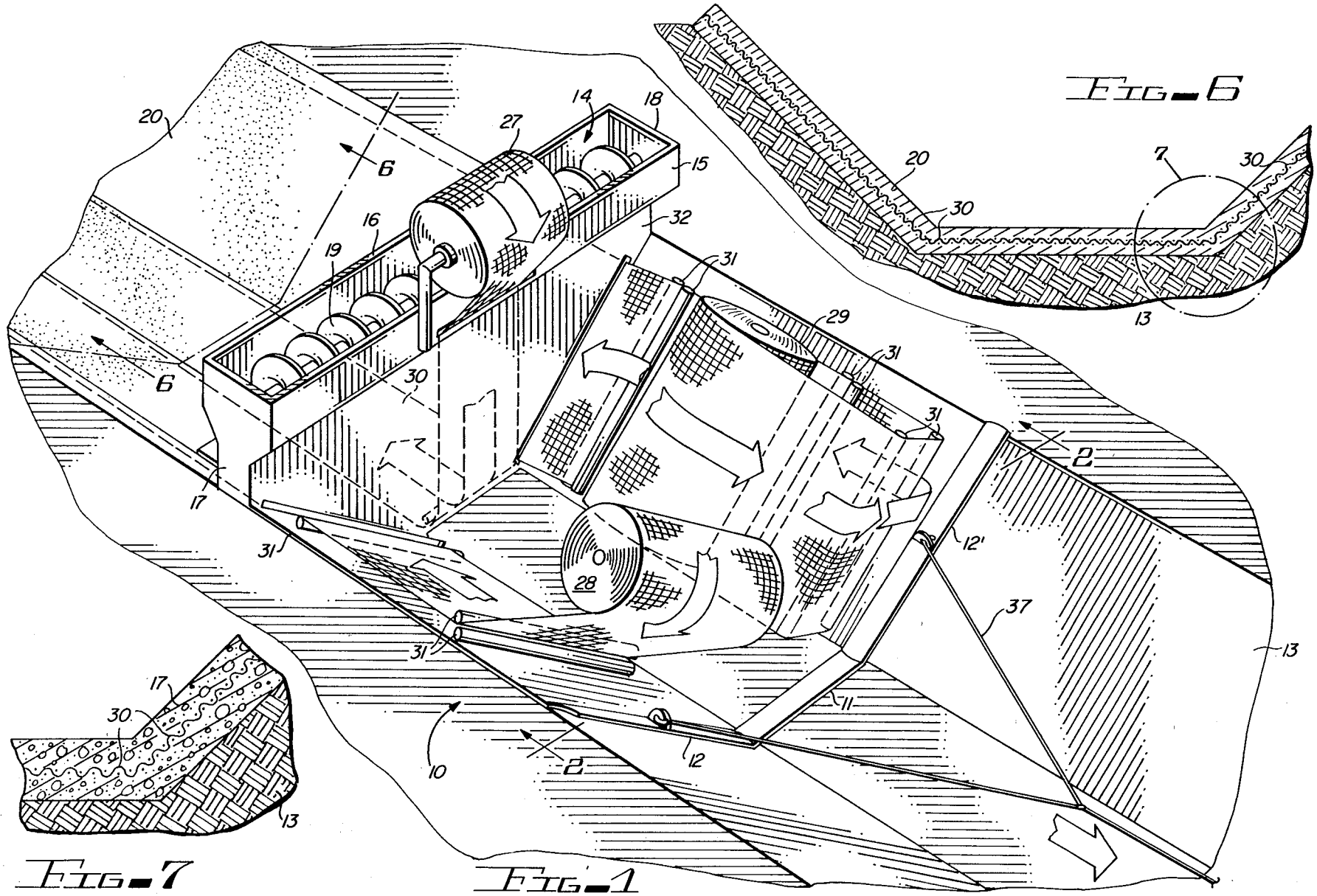
FIG. 1 is a partial perspective view of a ditch paving machine illustrating the method of installing wire mesh in a web of wet concrete being poured.
FIG. 6 is a partial cross-sectional view of a ditch being paved showing the wire mesh in place.
FIG. 7 is an enlarged view of the circled area of FIG. 6.

Referring more particularly to the drawings by characters of reference, FIGS. 1–8 disclose a skid, portable form or boat-shaped body 10 having its bottom 11 and outwardly slanting sides 12, 12' conformable to the corresponding parts of a prepared earthen ditch 13. At the forward end of this body, the bottom and sides form a prow-like configuration. To the rear of this prow, a hopper 14 is formed by a front plate 15, a rear plate 16 and upwardly extending end plates 17 and 18. A power driven worm or conveyor 19 is mounted within the hopper for equally distributing wet concrete 20 along its length.

Elongated rectangular concrete deposit vents 21, 22 and 23 are formed along the bottom of hopper 14. As noted from FIGS. 3–5, the bottom of hopper 10 is provided with baffle plates 24 and 25 for directing concrete to the three deposit vents 21–23. The slanting sides of the hopper formed by directive baffle plates 24 and 25 and the worm type conveyor 19 prevent the formation of pockets of cement in corners of the hopper, thereby insuring a continuous feeding of concrete from the hopper to the vents.

Figure 5:
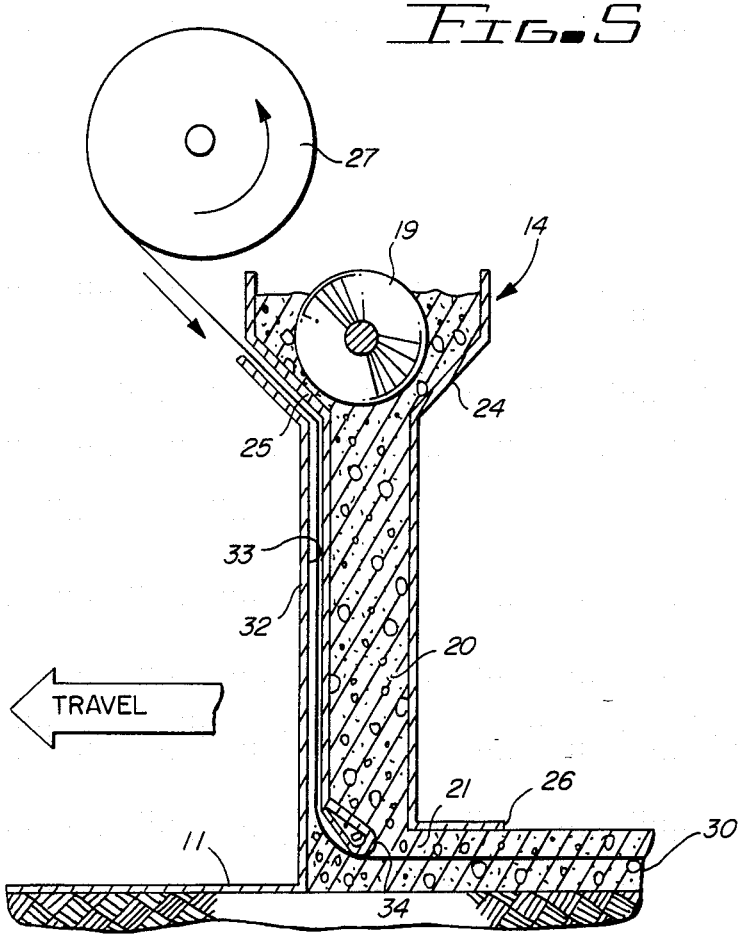
FIG. 5 is a cross-sectional view of FIG. 2 taken along the line 5—5.

The outer surfaces of the plates forming bottom 11 and sides 12, 12' of body 10 conform to the bottom and sides of the preformed ditch 13. Rearwardly extending portions 26 of baffle plates 24, as shown in FIGS. 3–5, extend from the front edges of deposit vents 21, 22 and 23 and are set above the surface of the preformed ditch 13 a distance equivalent to the thickness of the concrete lining desired. The inner faces of these rearwardly extending portions 26 of plates 24 form trowling surfaces. They extend rearwardly of the hopper a distance sufficient to provide adequate weight and balance for the entire body 10 and to provide sufficient trowling area to compact, smooth and finish the concrete after it has flowed out through the several vents.

In this regard, it should be noted that the center of gravity of the load of concrete placed in the hopper lies intermediate the ends of device 10 such that body 10 can be accurately held and guided by the preformed ditch independent of the rate of flow or plastic consistency of the cement being utilized to provide the proper thickness and uniformity for the finished ditch lining.

In accordance with the teachings of this invention, a roll of wire mesh is rotatively mounted on body 10 adjacent each of bottom 11 and sides 12, 12' so that the wire mesh may be fed through the associated vent and guided and positioned to lie within the web or layer of concrete being disposed in the ditch as a ditch lining.

Figure 8:
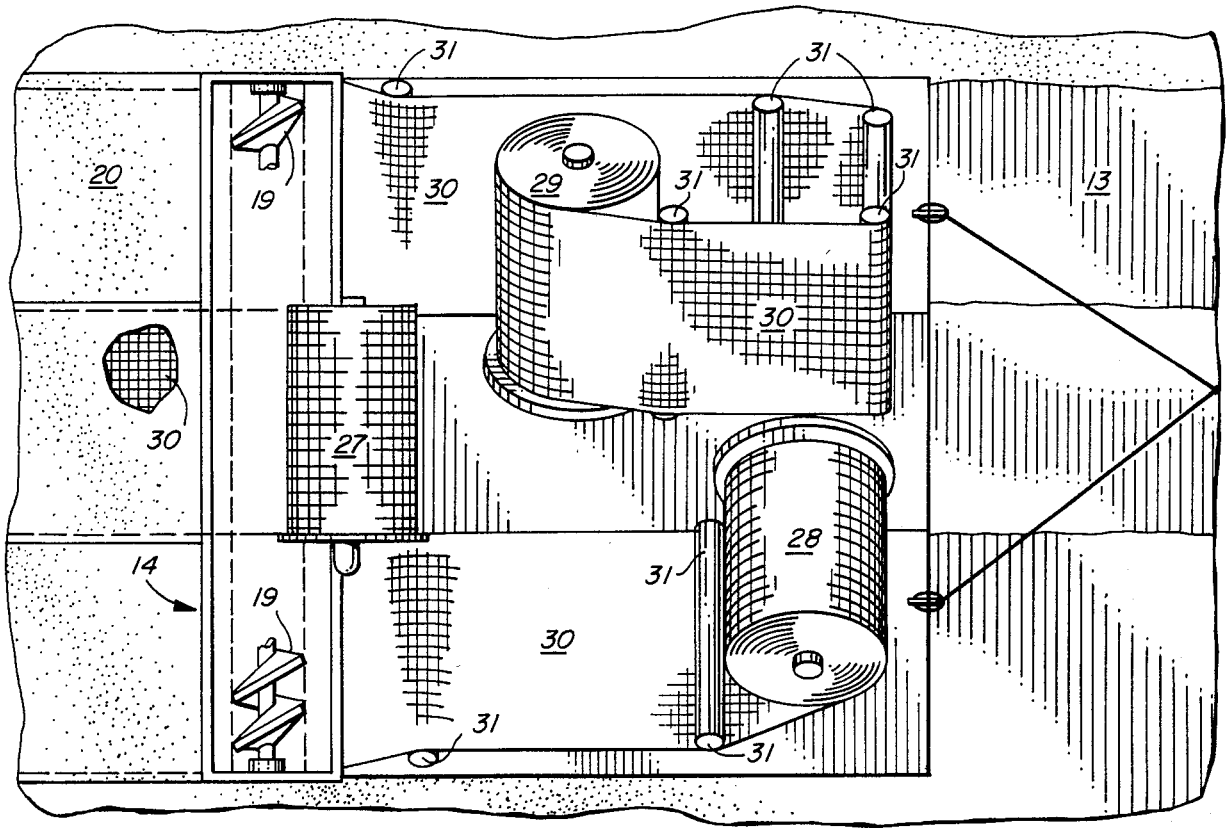
FIG. 8 is a partial plan view of FIG. 1.

As shown in FIGS. 1 and 8, three rolls of wire mesh 27, 28 and 29 are rotatively mounted on body 10, one juxtapositioned to each of the plates forming bottom 11 and sides 12, 12' and positioned so that the wire mesh 30 of each roll is fed over and between a combination of guide rollers 31 to and through an associated vent of hopper 14 in the manner shown.

As shown in FIGS. 1 and 5, a guide plate 32 is juxtapositioned to the center portion of baffle plate 25 of hopper 14 and forms a right angular extension of bottom 11 of body 10 of the skid shape device disclosed. This guide plate, together with the adjacent outside surface of baffle plate 25 of hopper 14, forms a channel 33 for guiding wire mesh from roll 27 to its associated vent 21.

The bottom edge of baffle plate 25 adjacent to each of side plates 12, 12' is slotted at 35 and 36, as shown in FIGS. 3 and 4, for guiding therethrough the wire mesh of the associated wire mesh rolls 28 and 29, respectively. The ends of side plate 25 inside of hopper 14, as shown in FIGS. 3, 4 and 5, are provided with guide means 34 for positioning the wire mesh passing through the adjacent vent intermediate and preferably in the center of the web of concrete being positioned on the surface of ditch 13.

In use, the ditch is formed to the shape required by a suitable ditching machine so that the earth in the bottom, sides and edges is firm and compacted. With the earthen ditch shaped as stated, body 10 is placed therein and a hitch formed by the guide cables 37 attached to a tractor (not shown). The attachment is made so that the line of traction tends to slightly elevate the prow of the device. It is not actually elevated in practice since the load of concrete in hopper 14 maintains device 10 in proper alignment with the preformed ditch, but with the prow in this direction, the prow does not tend to hog into the ditch.

The ends of each roll of wire mesh mounted on device 10 are then anchored at the starting end of the ditch lining operation in alignment with the surface of the ditch being paved so that as device 10 is being pulled along the ditch, the three rolls of wire mesh will rotatively dispense wire mesh along the associated surface of the ditch and within the web of wet concrete being dispensed through the associated hopper vents.

A portable cement mixer is then brought alongside of device 10 and arranged to deposit mix into hopper 14 and the concrete mixer and device 10 advance along the ditch at the same speed. The mixer is arranged to supply concrete to hopper 14 as fast as it is fed out of vents 21, 22 and 23 at the speed of travel along the ditch. If for any reason, it is necessary to stop the flow of concrete from the mixer, the movement along the ditch is halted.

The result is that the concrete is uniformly fed out of hopper 14 and evenly deposited simultaneously with a reinforcing wire mesh interiorly thereof as a lining at the bottom and sides of the earthen ditch. The portions 26 of baffle plate 24 smooth and trowel the layer of concrete deposited, while the forward plates forming bottom 11 and sides 12, 12' of body 10 provide the support and act as guides for the body 10 relative to the preformed ditch.

It should be noted that the adjacent edges of the rolls of wire mesh dispersed may abut or overlap to assure a complete reinforcement of the concrete lining applied to the surface of the ditch.

Although but one embodiment of the present invention has been illustrated and described, it will be apparent to those skilled in the art that various changes and modifications may be made therein without departing from the spirit of the invention or from the scope of the appended claims.

What is claimed is:

1. A portable sliding form for lining prepared earthen ditches having a bottom and slanting sides of predetermined sectional shape with reinforced cement comprising:

a skid formed of flat plates to provide a flat bottom and outwardly slanting sides conforming to the sectional shapes of the prepared ditch, said plates forming a prow at the forward end and terminating at the rear end to provide a trowling surface, a hopper formed on said skid between its ends by transversely upward extending spaced side members and end members, a cement deposit vent means cut in the rear mounted side member of said hopper adjacent to and along said bottom and said slanting sides of said skid, a trowling plate extending rearwardly of said rear mounted side member of said hopper and across and spaced from the bottom and slanting sides of the ditch a distance relating to the thickness of the desired concrete web being poured, a rectangular entrance means cut in the front mounted side member of said hopper adjacent said bottom and slanting sides of said skid, and wire mesh dispensing means mounted on said skid forwardly of said hopper in its direction of movement for dispensing wire mesh rearwardly through said entrance means into and through said hopper and out of said cement deposit vent means substantially within the center of the cement web being poured.

2. The portable sliding form for lining prepared earthen ditches as set forth in claim 1 wherein:

said wire mesh dispensing means comprises three rolls of wire mesh, one rotatively mounted adjacent each of the bottom and slanting sides of each skid.

3. The portable sliding form for lining prepared earthen ditches as set forth in claim 1 wherein:

the wire of said wire mesh dispensing means reinforces the complete width of the web of the cement being dispensed.

4. The portable sliding form for lining prepared earthen ditches as set forth in claim 2 wherein:

the wire of the three rolls dispensed overlap at their adjacent longitudinal edges to completely cover the width of the web of cement being dispensed.

5. The portable sliding form for lining prepared earthen ditches as set forth in claim 1 wherein:

said cement deposit vent means comprises a rectangular configuration.

6. A method of lining prepared earthen ditches having a bottom and slanting sides of predetermined sectional shape with reinforced cement comprising the steps of:

moving a form along the prepared earthen ditch, dispensing a web of a predetermined thickness of cement along the bottom and sides of the ditch, and simultaneously inserting a wire mesh reinforcing means in substantially the center of the web of cement being dispensed during movement of said form.

7. The method set forth in claim 6 wherein:

the wire mesh extends substantially the full width of said web of cement.

8. The method set forth in claim 6 wherein:

said reinforcing means comprises three rolls of wire mesh, and simultaneously inserting the wire mesh being dispensed in the web of cement covering the bottom and sides of the ditch.

9. The method set forth in claim 8 wherein:

the wire mesh being dispensed is in abutting relationship with the wire mesh from the adjacent roll.

10. The method set forth in claim 8 wherein:

the wire mesh being dispensed is in overlapping arrangement with the wire mesh from the adjacent roll.

* * * * *